US009545713B2

(12) United States Patent
Johnson et al.

(10) Patent No.: US 9,545,713 B2
(45) Date of Patent: Jan. 17, 2017

(54) POWER TOOLS WITH HOUSINGS HAVING INTEGRAL RESILIENT MOTOR MOUNTS

(75) Inventors: Joshua Odell Johnson, Allentown, PA (US); Dominic Leonard Power, Washington, NJ (US); Joseph Constantine Bouboulis, Asbury, NJ (US)

(73) Assignee: Ingersoll-Rand Company, Davidson, NC (US)

( * ) Notice: Subject to any disclaimer, the term of this patent is extended or adjusted under 35 U.S.C. 154(b) by 504 days.

(21) Appl. No.: 14/127,749

(22) PCT Filed: Jun. 29, 2011

(86) PCT No.: PCT/US2011/042275

§ 371 (c)(1),
(2), (4) Date: Dec. 19, 2013

(87) PCT Pub. No.: WO2013/002776

PCT Pub. Date: Jan. 3, 2013

(65) Prior Publication Data

US 2014/0124230 A1 May 8, 2014

(51) Int. Cl.
*B25F 5/02* (2006.01)
*B25F 5/00* (2006.01)

(52) U.S. Cl.
CPC ..... *B25F 5/02* (2013.01); *B25F 5/006* (2013.01); *Y10T 29/49826* (2015.01)

(58) Field of Classification Search
CPC ..... B25F 5/02; E21B 4/12
USPC ..... 173/162.1, 170, 216, 217; 310/47, 50
See application file for complete search history.

(56) References Cited

U.S. PATENT DOCUMENTS

| | | | | |
|---|---|---|---|---|
| 4,648,579 | A | 3/1987 | Wilson | |
| 4,700,876 | A | 10/1987 | Wingert | |
| 4,730,134 | A * | 3/1988 | Sistare | B23B 45/001 310/50 |
| 5,027,910 | A | 7/1991 | Honsa et al. | |
| 6,328,724 | B1 | 12/2001 | Ronnberg et al. | |
| 6,431,289 | B1 | 8/2002 | Potter et al. | |
| 6,517,251 | B1 | 2/2003 | Williams | |
| 6,805,207 | B2 | 10/2004 | Hagan et al. | |

(Continued)

FOREIGN PATENT DOCUMENTS

| | | |
|---|---|---|
| DE | 4226903 A1 | 2/1994 |
| DE | 102009028247 A1 | 2/2011 |

(Continued)

OTHER PUBLICATIONS

Supplementary Search Report dated Dec. 1, 2015 from European Patent Application No. EP11868785.4 filed Jun. 29, 2011.

(Continued)

*Primary Examiner* — Nathaniel Chukwurah
(74) *Attorney, Agent, or Firm* — Sunstone IP

(57) ABSTRACT

Power tool housing shells that matably attach to each other and define an interior cavity that is sized and configured to encase at least a motor associated with a power train for a power tool. Each housing shell is a substantially rigid molded shell body. Each housing shell inner surface includes at least one overmold motor mount member of a resilient material directly, integrally attached to an inner surface of the respective housing shell.

20 Claims, 13 Drawing Sheets

(56) References Cited

U.S. PATENT DOCUMENTS

| | | | | |
|---|---|---|---|---|
| 7,090,032 | B2 * | 8/2006 | Wada | B25B 21/02 173/128 |
| 7,152,695 | B2 * | 12/2006 | Happ | B25F 5/006 173/162.1 |
| 7,686,199 | B2 | 3/2010 | Gross et al. | |
| 7,726,536 | B2 | 6/2010 | Gross et al. | |
| 7,789,169 | B2 | 9/2010 | Berry et al. | |
| 7,866,412 | B2 | 1/2011 | Avis | |
| 7,896,103 | B2 * | 3/2011 | Johnson | B25F 5/02 173/162.1 |
| 2002/0096341 | A1 | 7/2002 | Hagan et al. | |
| 2003/0107273 | A1 | 6/2003 | Ikeda et al. | |
| 2005/0028997 | A1 | 2/2005 | Hagan et al. | |
| 2005/0217416 | A1 | 10/2005 | Berry et al. | |
| 2005/0218184 | A1 | 10/2005 | Buck et al. | |
| 2006/0266184 | A1 | 11/2006 | Hetcher et al. | |
| 2007/0246237 | A1 | 10/2007 | Homsi et al. | |
| 2009/0114412 | A1 | 5/2009 | Hatfield | |
| 2009/0194306 | A1 | 8/2009 | Johnson et al. | |
| 2010/0300641 | A1 | 12/2010 | Purohit et al. | |

FOREIGN PATENT DOCUMENTS

| | | | |
|---|---|---|---|
| JP | 2002254340 | A1 | 9/2002 |
| JP | 2005/297114 | | 10/2005 |

OTHER PUBLICATIONS

International Search Report for corresponding PCT Application No. PCT/US2011/042275, Date of mailing Mar. 26, 2012.

Venkataswamy et al., Overmolding of Thermoplastic Elastomers: Engineered solutions for consumer product differentiation, GLS Corportation, McHenry, Illinois, Jun. 19, 2007, pp. 1-18.

Overmolding Guide, GIS Corporation, McHenry, Illinois, © 2004, 11 pages.

* cited by examiner

POWER TOOLS WITH HOUSINGS HAVING INTEGRAL RESILIENT MOTOR MOUNTS

RELATED APPLICATION

This application is a 35 U.S.C. §371 national phase application of PCT/US2011/042275, filed Jun. 29, 2011, the contents of which are hereby incorporated by reference as if recited in full herein.

FIELD OF THE INVENTION

This invention relates to power tools and is particularly suitable for housings for power tools.

BACKGROUND OF THE INVENTION

Various power tools, including corded electric, cordless electric and pneumatic tools, are well-known. Examples of such tools include, but are not limited to, drills, drill drivers, impact wrenches, grease guns and the like. Many of these tools have a pistol style housing generally including a tool body defining a head portion with a handle depending therefrom, but other form factors can be used. A trigger or the like is typically provided at the forward junction of the head portion and the handle. In an effort to make such tools lighter, the tool body can be manufactured from an elastomer such as plastic or the like formed in a clam shell manner in which opposed halves of the body are formed separately and then joined together. During use or handling, or inadvertent dropping of the tool, vibration can be undesirably transmitted though the housing and/or components therein to the motor.

SUMMARY OF EMBODIMENTS OF THE INVENTION

Embodiments of the invention are directed to providing housings with integral, resilient (e.g., elastomeric or rubber) overmold motor mounts that can reduce vibration transmitted between the housing and motor.

Some embodiments are directed to a power tool housing. The housing includes first and second housing shells that each have an outer wall that encases inner surfaces. The housing shells matably attach to each other and define an interior motor cavity that is sized and configured to encase at least a motor associated with a power train for a power tool. Each housing shell is a substantially rigid molded shell body. Each housing shell includes a plurality of axially spaced apart overmold motor mount member portions comprising a resilient material that are directly, integrally attached to at least one inner surface of the respective housing shell. One or sets of the axially spaced apart overmold motor mount member portions of each shell are aligned and cooperate to define a plurality of motor mount members.

At least some of the overmold motor mount members can be between about 1 mm to about 10 mm in a width dimension associated with an axial direction of the interior cavity (which may be a substantially cylindrical cavity) and can project inwardly a distance from an underlying shell attachment surface.

The motor mount members can be a plurality of curved motor mount members, each member defined by aligned cooperating elastomeric overmold material on each shell, with at least one motor mount member residing proximate a front end of the interior cavity and at least one motor mount member spaced apart and residing closer to a rear end of the interior cavity.

Each housing shell can include at least one overmold motor mount portion that defines a respective motor mount member and resides intermediate a pair of closely spaced apart housing ribs. The ribs extend inwardly from an inner surface of the respective housing shell and also extend circumferentially between about 90-180 degrees about the substantially cylindrical cavity. The overmold motor mount portions can project outwardly from the respective ribs between about 0.25 mm to about 1 mm.

The overmold motor mount members can be at least two axially spaced apart curved motor mount members, each defined by cooperating elastomeric material overmold portions integrally attached to the rigid substrate of respective housing shells. The elastomeric material overmold portions extend circumferentially between about 90-180 degrees about the substantially cylindrical cavity.

The first and second housing shells can be right and left clam shell housings with a lower upwardly extending handle portion that merges into an upper axially extending elongate portion that defines the substantially cylindrical interior cavity. The overmold motor mount members can be a plurality of axially spaced apart curved overmold motor mount members, including a rear motor mount member residing adjacent an interior rear corner of a substantially cylindrical interior cavity.

The motor mount member that resides closer to the rear of the interior cavity can have a radius of curvature extending from a centerline of the cavity to the shell with a circumferentially extending arc that is between about 90-170 degrees in each respective housing shell.

The motor mount member that resides closer to the rear of the interior cavity can have a stepped configuration, with (i) a forward portion that is sized and configured to snugly abut an outer wall of a motor held thereat, the forward portion being discontinuous about its circumferentially extending length and (ii) a second portion that is substantially orthogonal to the first portion and has a planar configuration that extends inwardly from the first portion a short distance of between about 1 mm to about 30 mm.

The overmold motor mount members can include a plurality of narrow, axially spaced apart members that project inwardly from an underlying housing shell attachment surface between about 0.5 mm to about 10 mm.

The overmold motor mount members can be a plurality of narrow, axially spaced apart members that are integrally attached to and project inwardly from a substantially planar sub-surface that is spaced apart from the housing shell outer wall and is attached to the outer wall of the shell via inwardly extending ribs.

The housing shell inner surfaces can include circumferentially extending support ribs and interior planar sub-surfaces extending in an axial direction attached to the ribs. The at least one curved overmold motor mount member is integrally attached to the sub-surface.

Still other embodiments are directed to methods of fabricating a housing shell with integrated resilient overmold material for at least one motor mount of a power tool. The methods include: (a) molding a first substrate material into a substantially rigid housing shell of a power tool with an outer surface and an inner surface; and (b) overmolding a resilient second substrate material directly onto the interior surface of the rigid housing shell such that the overmolded resilient material forms at least one curved short axially extending segment that circumferentially extends about and is integrally attached to the interior surface of the rigid housing shell and projects inwardly a distance to define a portion of at least one resilient motor mount.

The molding step can be carried out to form at least a plurality of curved circumferentially extending closely spaced apart ribs with a cavity therebetween. The overmolding step can be carried out using the circumferentially extending ribs and respective cavities to form a plurality of curved resilient segments and the overmolding step forms the curved segment so that they extend a distance beyond the rigid housing shell curved ribs.

Yet other embodiments are directed to power tools. The power tools include first and second housing shells that matably attach to each other and define an interior motor cavity. Each housing shell is a substantially rigid molded shell body that defines an outer wall and inner surfaces. Each of the first and second housing shells includes at least one cooperating portion of a resilient overmold motor mount member that is integrally attached to at least one of the inner surfaces of a respective housing shell. The tool includes a motor that resides in the interior motor cavity, the motor having an outer wall that snugly abuts the overmold motor mount portions.

Each housing shell can include a plurality of axially spaced apart resilient overmold motor mount portions that are integrally attached to defined locations of at least one of the inner surfaces of the respective housing shell and cooperate to define respective overmold motor mount members. At least two of the overmold motor mount portions can have a width dimension associated with an axially extending direction of the interior motor cavity that is between about 0.5 mm to about 10 mm.

The power tool can also include a gear carrier with opposing end portions residing aligned with the motor in the housing shell. The end portion facing the motor includes a substantially planar resilient overmold portion directly integrally attached thereto, the overmold portion having an open center space. The gear carrier overmold portion can optionally include arcuate corners, each with an open space.

The overmold motor mount members can be between about 1 mm to about 10 mm in a width dimension associated with an axial direction of the cylindrical cavity.

Each housing shell can include at least one pair of closely spaced interior ribs with a cavity therebetween. At least some of the overmold motor mount portions reside in the cavity intermediate the pair of closely spaced apart ribs. The ribs extend inwardly from an inner surface of the respective housing shell and also extend circumferentially between about 90-180 degrees about a substantially cylindrical interior cavity. The overmold motor mount portions can project outwardly from the respective ribs between about 0.25 mm to about 1 mm.

One of motor mount resilient portions of each housing shell can be associated with a rear motor mount that resides closer to the rear of the cavity and has a radius of curvature extending from a centerline of the cavity to the respective housing shell with a circumferentially extending arc in each respective housing shell that is between about 90-170 degrees.

The rear motor mount that resides closer to the rear of the interior cavity can include a motor mount resilient portion that has a stepped configuration, with (i) a forward portion that is sized and configured to snugly abut an outer cylindrical wall of a motor held thereat being discontinuous about its circumferentially extending length and (ii) a second portion that is substantially orthogonal to the first portion and has a planar configuration that extends inwardly from the first portion a short distance between about 1 mm to about 30 mm.

The first and second housing shells can be right and left clam shell housings with a lower upwardly extending handle portion that merges into an upper axially extending elongate portion that defines the substantially cylindrical interior cavity. The overmold motor mount portions can include rear motor mount portions that reside in each housing shell adjacent an interior rear corner of the substantially cylindrical cavity. The rear motor mount portions have at least one of a segmented configuration or a circumferentially extending arc length that this less than about 170 degrees.

Still other embodiments are directed to methods of assembling a power tool. The methods include: (a) providing left and right housing shells that define a motor cavity when assembled together, each housing shell having a plurality of spaced apart elastomeric overmold motor mounts on an interior surface thereof, at least some of which are narrow in width (in an axially extending dimension) with a width of between about 1 mm to about 20 mm; (b) aligning the left and right shells so that motor mounts in each shell define corresponding sets of motor mounts that face each other and extend about a portion of a perimeter of the motor thereat; (c) placing a motor between the left and right housing shells; and (d) attaching the left and right housing shells together, thereby forcing the elastomeric motor mounts to compress against an outer surface of the motor. Optionally, before the attaching step, the method may include placing a gear carrier with an integral overmold elastomeric material on a primary surface in the housing shells aligned with a rotor extending from the motor so that the overmold material between the gear carrier and motor is compressed before or in response to the attaching step.

The foregoing and other objects and aspects of the present invention are explained in detail in the specification set forth below.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DESCRIPTION OF EMBODIMENTS OF THE INVENTION

Figure 1B:
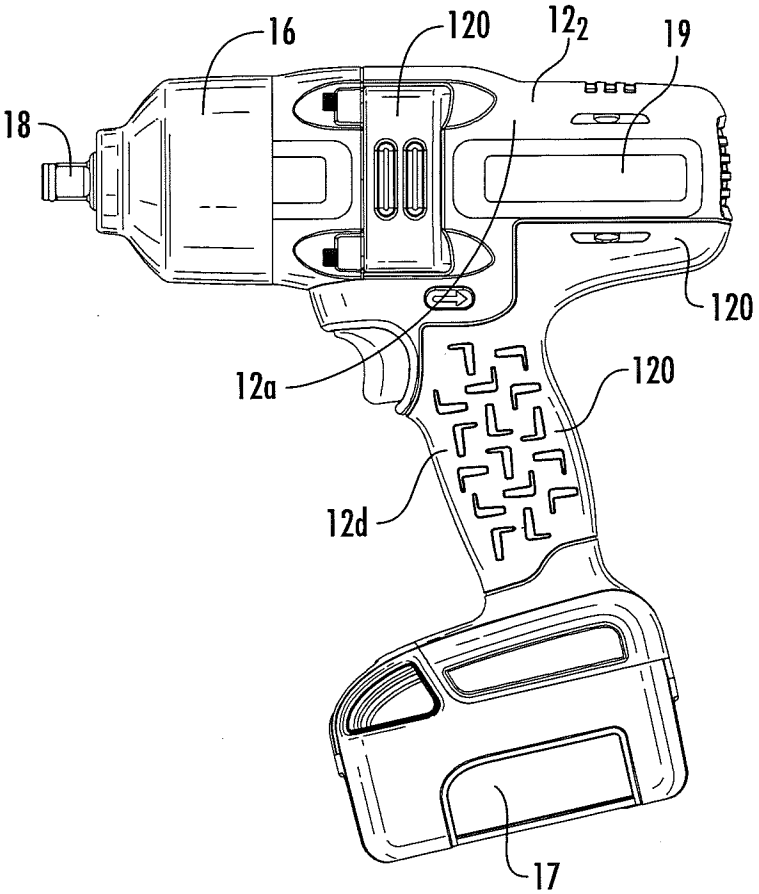
FIG. 1B is a side view of the tool shown in FIG. 1A.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain layers, components or features may be exaggerated for clarity, and broken lines illustrate optional features or operations unless specified otherwise. In addition, the sequence of operations (or steps) is not limited to the order presented in the figures and/or claims unless specifically indicated otherwise. In the drawings, the thickness of lines, layers, features, components and/or regions may be exaggerated for clarity and broken lines illustrate optional features or operations, unless specified otherwise.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "comprises," "comprising," "includes," and/or "including" when used in this specification, specify the presence of stated features, regions, steps, operations, elements, and/or components, but do not preclude the presence or addition of one or more other features, regions, steps, operations, elements, components, and/or groups thereof.

It will be understood that when a feature, such as a layer, region or substrate, is referred to as being "on" another feature or element, it can be directly on the other feature or element or intervening features and/or elements may also be present. In contrast, when an element is referred to as being "directly on" another feature or element, there are no intervening elements present. It will also be understood that, when a feature or element is referred to as being "connected", "attached" or "coupled" to another feature or element, it can be directly connected, attached or coupled to the other element or intervening elements may be present. In contrast, when a feature or element is referred to as being "directly connected", "directly attached" or "directly coupled" to another element, there are no intervening elements present. Although described or shown with respect to one embodiment, the features so described or shown can apply to other embodiments.

The term "overmold" when used with respect to the "motor mount" member recitation, refers to a physical attachment configuration, similar to the use of a weld or adhesive attachment type. Thus, as used, the term "overmold" used with the "motor mount" feature, is a positive structural term for the attachment type, e.g., a resilient material that is overmolded onto a substrate to create a physical bond, rather than a process limitation.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the present application and relevant art and should not be interpreted in an idealized or overly formal sense unless expressly so defined herein.

The term "cordless" power tool refers to power tools that do not require plug-in, hard-wired ("corded") electrical connections to an external power source to operate. Rather, the cordless power tools have electric motors that are powered by on-board batteries, such as rechargeable batteries. A range of batteries may fit a range of cordless tools. Different cordless power tools may have a variety of electrical current demand profiles that operate more efficiently with batteries providing a suitable range of voltages and current capacities. The different cordless (e.g., battery powered) power tools can include, for example, screwdrivers, ratchets, nutrunners, impacts, drills, drill drivers, grease guns and the like.

Embodiments of the invention may be particularly suitable for precision power tool that can be used for applications where more exact control of the applied output is desired.

Figure 1A:
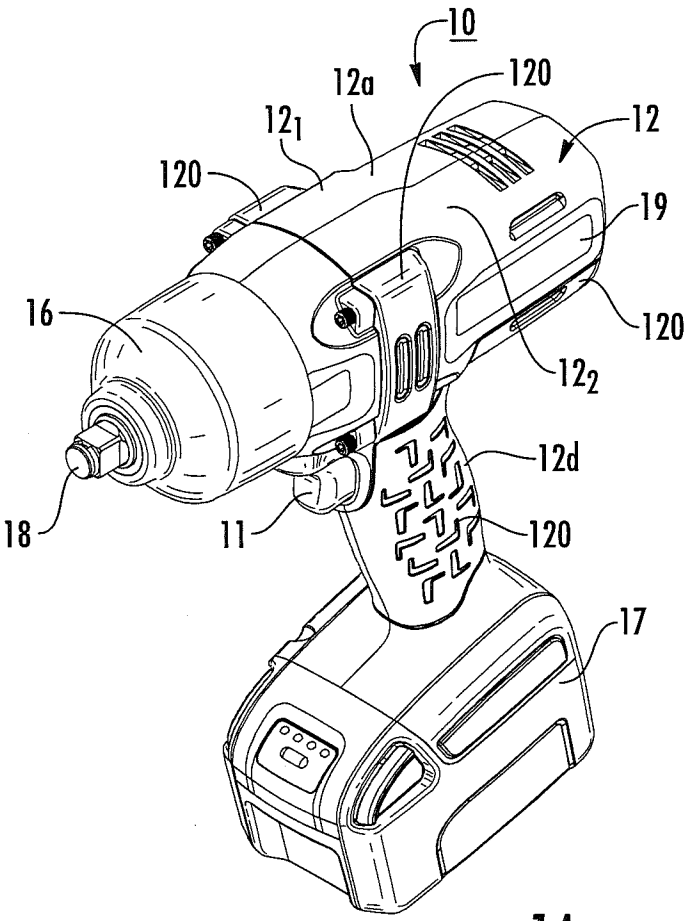
FIG. 1A is a side perspective view of an exemplary cordless power tool according to embodiments of the present invention.
Figure 2:
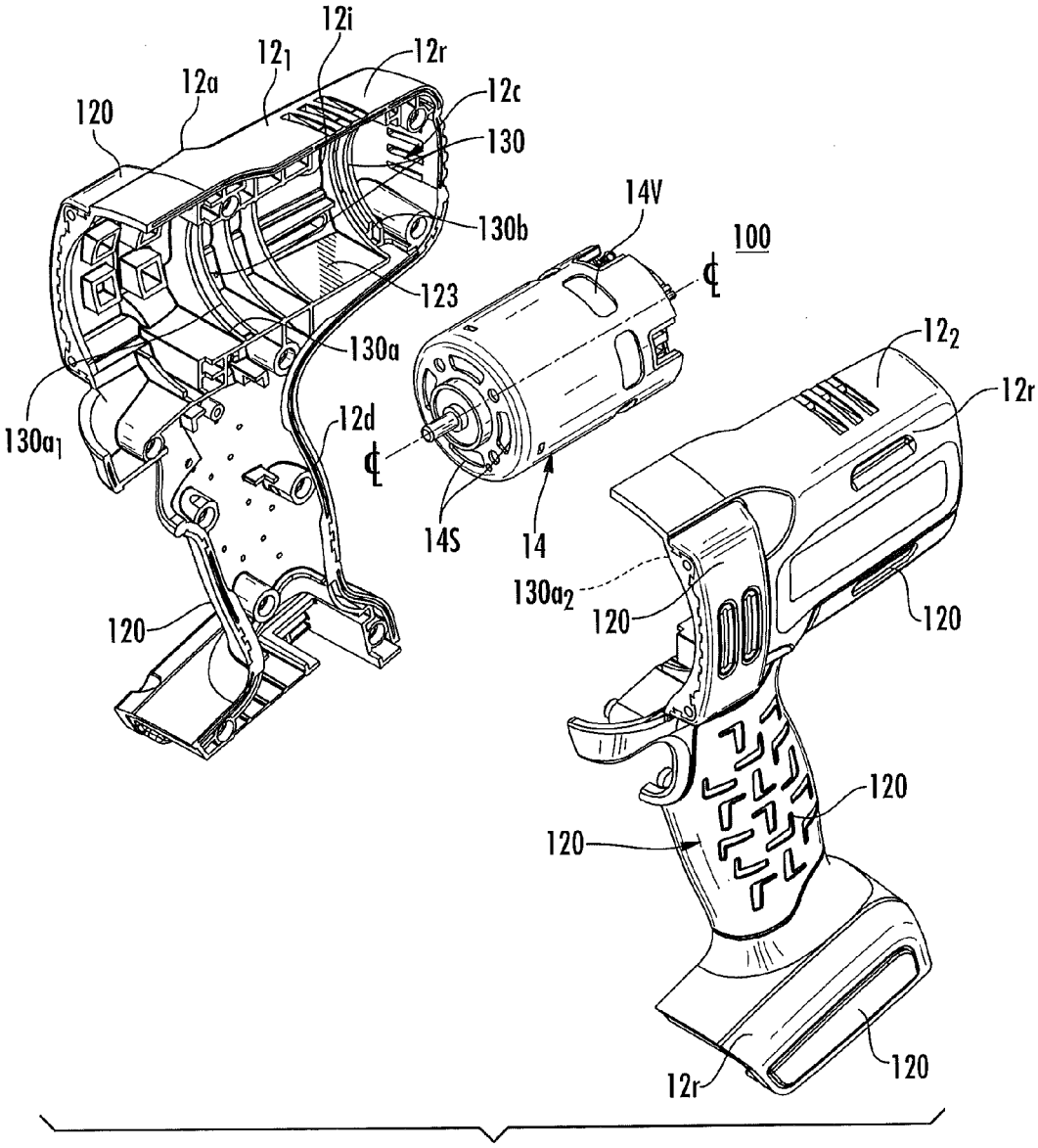
FIG. 2 is a partial exploded side perspective view of the power tool shown in FIG. 1A according to embodiments of the present invention.
Figure 11:
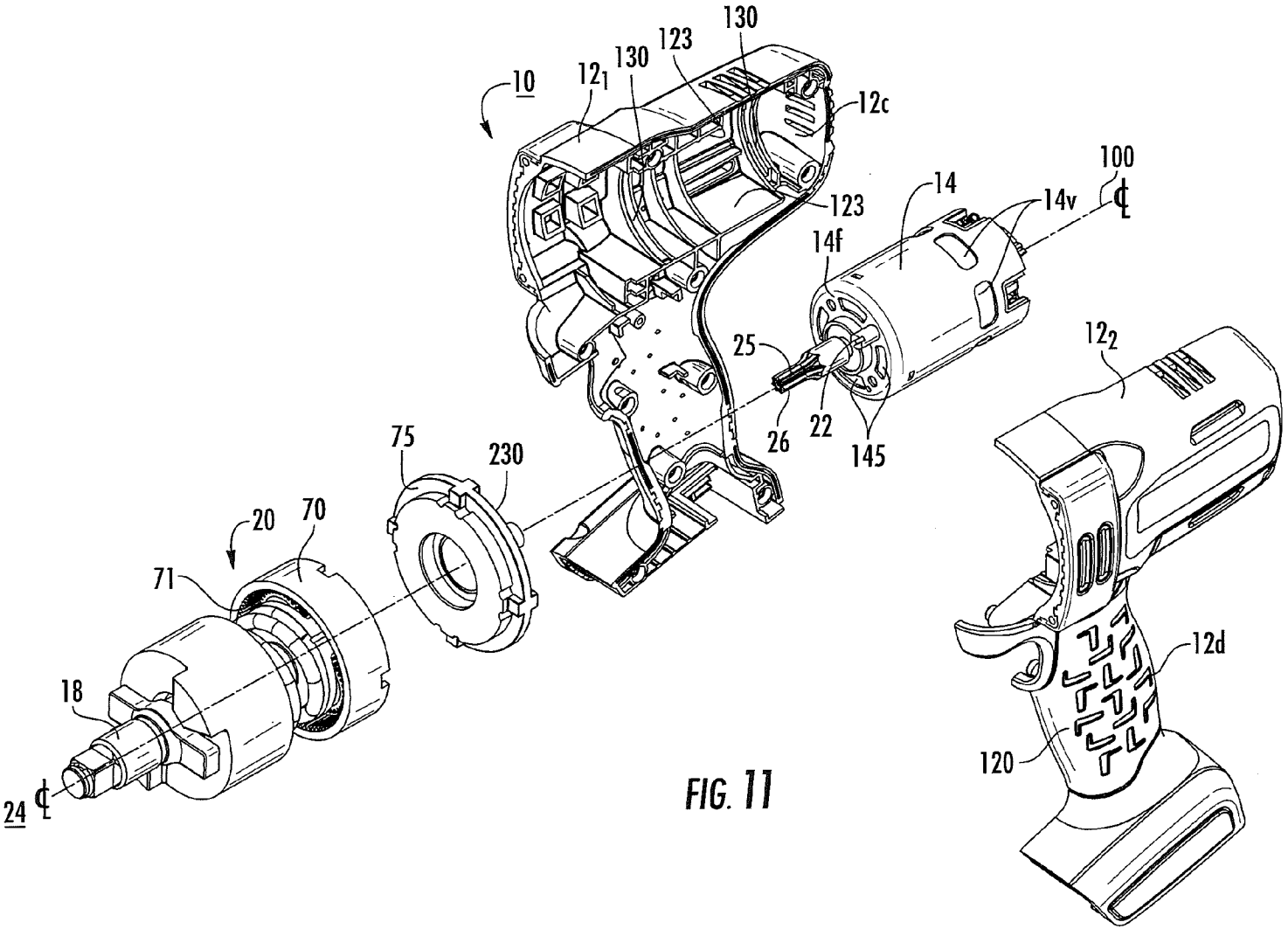
FIG. 11 is an exploded side perspective view of a power tool with the shown in FIG. 1A with the gear carrier, housing and motor shown in FIG. 10 according to embodiments of the present invention.
Figure 12:
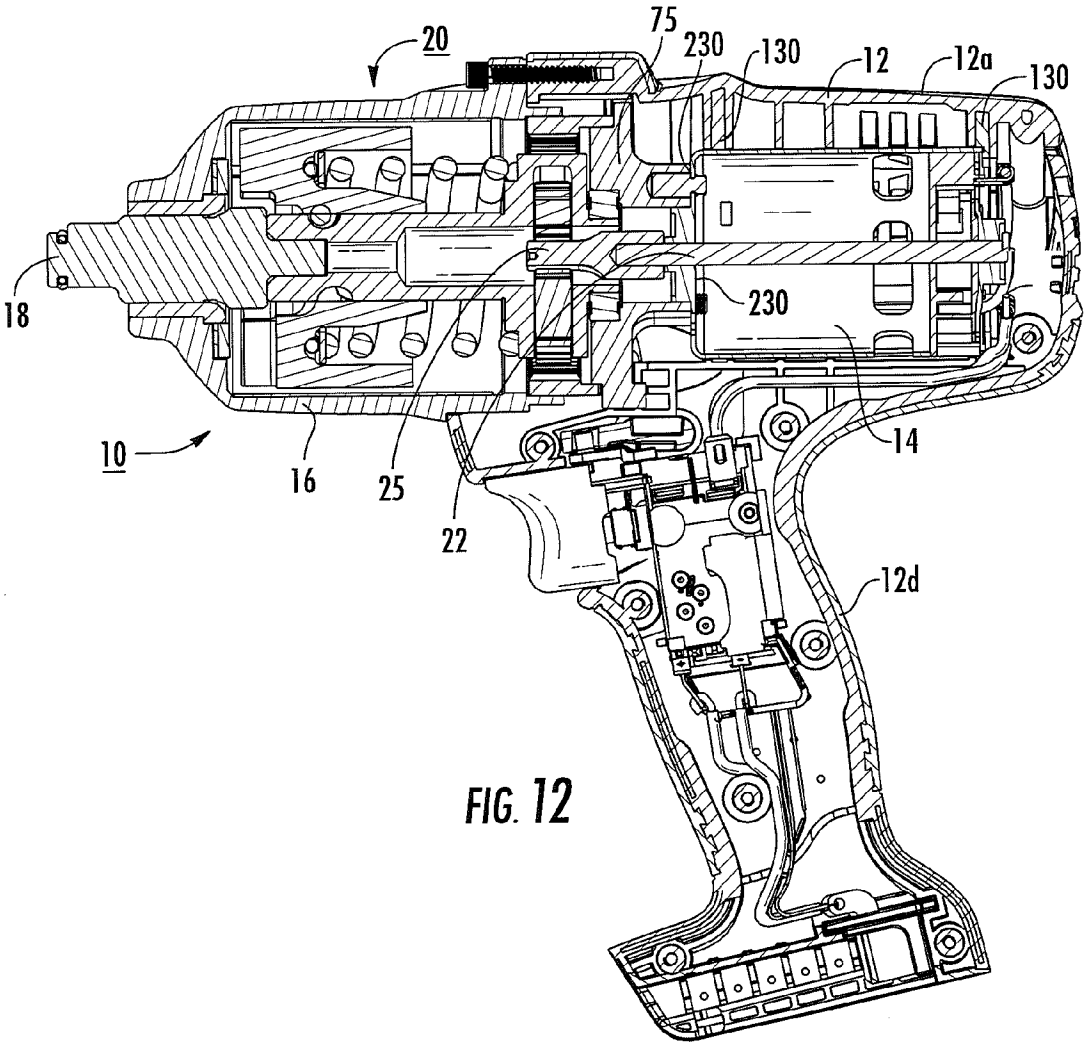
FIG. 12 is a side section assembled view of the power tool shown in FIG. 11 according to embodiments of the present invention.

FIGS. 1A and 1B illustrate an example of a type of power tool 10 that includes a housing 12, a gearcase 16 and a tool output shaft 18. As shown in FIGS. 1A, 1B and 2, the housing 12 encases a motor 14 and partially surrounds the gearcase 16. The gearcase 16 can be metallic and encloses a drive train 20 (FIGS. 11 and 12). In this embodiment, the lower portion of the housing can releasably engage a battery 17. The housing 12 can include an external control such as a trigger 11 and a UI (user interface) 19 with a display. However, the tool 10 and/or housing 12 can have other configurations and may enclose the gearcase and/or have other handle configurations.

In some embodiments, and as shown, the housing can be a "pistol" type housing that can include first and second substantially symmetrical clam shell bodies $\mathbf{12}_1$, $\mathbf{12}_2$ with an upper substantially axially extending head portion 12*a* that merges into a downwardly extending hand grip portion 12*d*.

As is well known to those of skill in the art, the housing shell bodies $\mathbf{12}_1$, $\mathbf{12}_2$ can be formed of a substantially rigid substrate 12*r* that has sufficient structural strength (and hardness) to be able to support the tool components, with or without reinforcement members. The substantially rigid substrate 12*r* for each shell body $\mathbf{12}_1$, $\mathbf{12}_2$, can comprise a single or multi-shot, injection-molded shell body. An example of a suitable moldable composite material is glass-filled nylon. However, other non-metallic materials, typically composite materials that comprise polymeric materials, can be used, particularly those with a hardness or durometer of at least about 90 Shore A.

Still referring to FIGS. 1A and 1B, the outer surface of the housing bodies $\mathbf{12}_1$, $\mathbf{12}_2$ can include external overmold portions 120 of an elastomeric (e.g., rubber or rubber-like) material, such as a thermoplastic elastomeric material, that can provide a softer tactile grip relative to the rigid substrate material 12*r* of the housing shells $\mathbf{12}_1$, $\mathbf{12}_2$. The external overmold portions 120 may alternatively or additionally provide some shock protection for internal components due to inadvertent drops and the like. The external overmold portions 120 may all be formed of the same material or some may be formed of different materials with the same or different Shore A durometers. In particular embodiments, the overmold material can have, for example, a Shore A durometer that is between about 40-80, more typically between about 40-60. There are many suitable elastomeric materials as is well known to those of skill in the art.

As shown in FIG. 2, the housing 12 can also include at least one integral, internal resilient overmold motor mount member 130, typically a plurality of spaced-apart motor mount members 130. Each housing shell $\mathbf{12}_1$, $\mathbf{12}_2$, can include a portion of a respective motor mount member. When assembled, the shell bodies $\mathbf{12}_1$, $\mathbf{12}_2$ align the corresponding motor mount member portions $\mathbf{130}a_1$, $\mathbf{130}a_2$, which snugly abut and surround or partially surround opposing (typically diametrically opposing) sides of an outer wall of the motor 14. The motor mount members 130 are formed by an overmold of a material that has less rigidity than the housing substrate 12*r* and is directly, integrally (moldably) attached to an inner surface of the respective rigid substrate 12*r* of each housing shell $\mathbf{12}_1$, $\mathbf{12}_2$. The at least one motor mount member 130 can help isolate the housing 12 and/or components held in the housing from the motor 14 from vibrations associated with normal power tool operation and can absorb and distribute the load during an impact caused by dropping the tool. The at least one motor mount member 130 is typically a plurality of axially spaced apart members, at least one of which is defined by one or more cooperating, aligned overmold portions in each shell. The cooperating portions of each member 130 in each shell may have the same width and/or depth or may have different widths or depths. The at least one overmold motor mount member 130 can have a Shore A hardness of between about 20 to about 70, more typically between about 40 to about 60. In some embodiments, the at least one motor mount member 130 may have a Shore A hardness of about 60.

The at least one motor mount member 130 has a strong attachment via an adhesive bond with a peel strength or force that is greater than about 15 lbs/linear inch, typically greater than about 20 lbs/linear inch, or via a cohesive bond. The term "cohesive bond" refers to a bond that cannot be separated with the discrete materials intact. For cohesive bonds, the materials themselves fail when attempting to separate them. For example, if the rigid (nylon or other suitable polymer and/or composite) substrate 12*r* and the resilient overmold (thermoplastic elastomer "TPE") member 130 are attached via a cohesive bond, one or both components will split, rupture or otherwise degrade such that one cannot be separated from the other intact.

In some embodiments, the at least one overmold motor mount member 130 can comprise the same material as one or all of the external overmold portions 120. For example, the same thermoplastic elastomer can be used for both the exterior and the interior overmolds 120, 130 to form softer (rubber) features relative to the substrate 12*r*. The thermoplastic elastomer material can comprise any suitable TPE material, examples of which may include, but are not limited to, DuPont™ ETPV (engineering thermoplastic vulcanates) 60A01HSL BK001, DuPont™ ETPV 90A01HS BK001, the Versaflex™ OM series from GLS Corporation, Mt. Henry, Ill., such as the Versaflex™ OM 6240-1 and OM 6258-9 TPE alloys.

The elastomeric material of the motor mount member(s) 130 can comprise additives and/or coatings for impact modifiers and/or additional thermal insulation.

Figure 3:
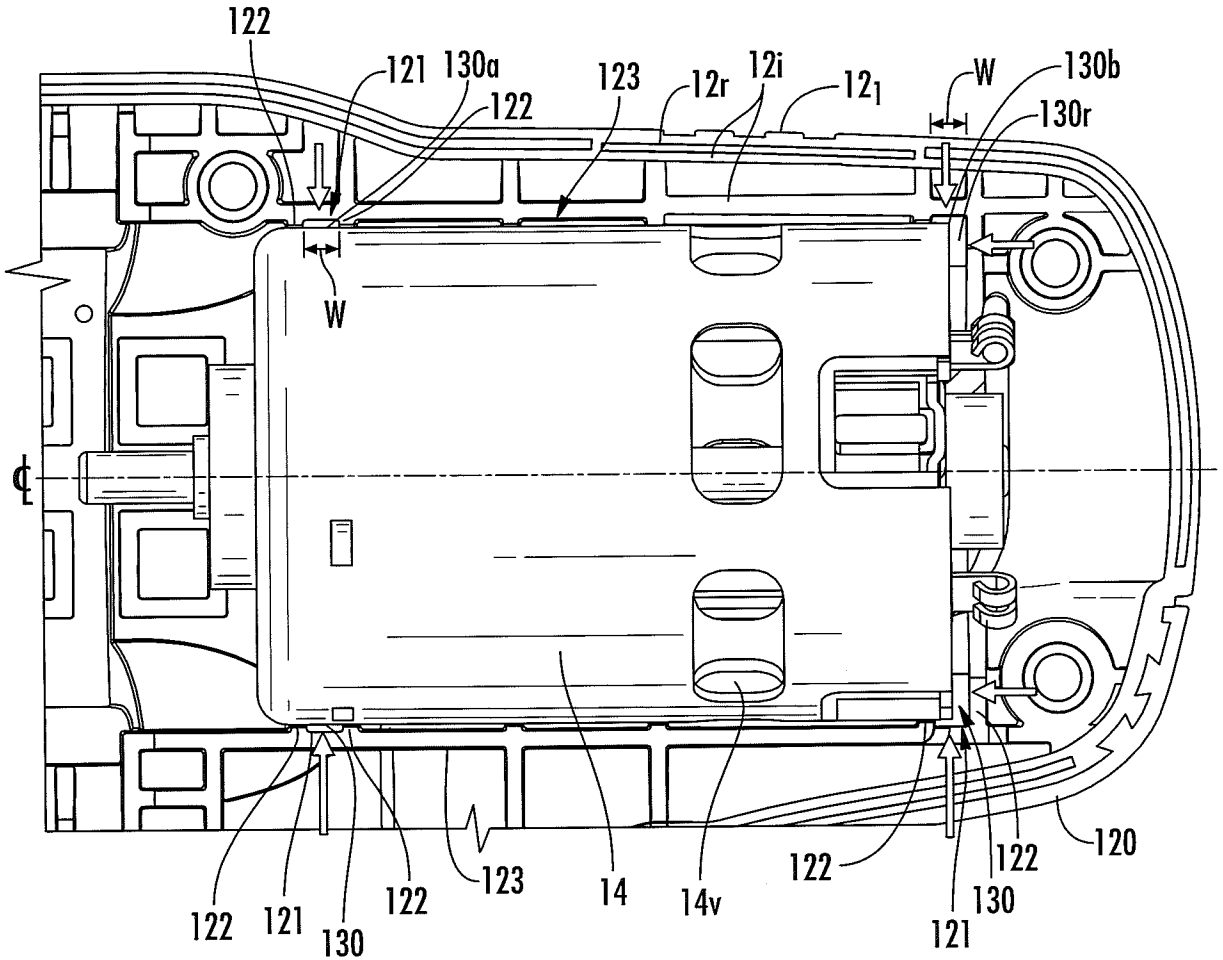
FIG. 3 is an enlarged partial section view of a rear portion the tool shown in FIG. 2 according to embodiments of the present invention.

The housing shells $\mathbf{12}_1$, $\mathbf{12}_2$ can define an interior motor cavity 12*c* that holds the motor 14 therein as shown in FIGS. 2 and 3. The cavity may be substantially cylindrical to substantially conform to a cylindrical motor. However, the motor 14 may have other shapes, such as rectangular or square, and the interior cavity 12*c* can be configured to accommodate that shape. In addition, the interior cavity 12*c* can be formed with ribs or other internal structures that have a shape that substantially corresponds to that of an outerwall of a motor for that tool.

The at least one motor mount member 130 can, in some embodiments, be curved and have a diameter that is slightly smaller than that of an outer wall of a target motor that is held therein.

The at least one member 30 can include sets of overmold material portions (typically pairs) that are sized and configured to integrally attach to an inner surface of the respective housing shell $\mathbf{12}_1$, $\mathbf{12}_2$ and are aligned to reside on opposing sides of the motor 14 and project a distance inwardly from the respective housing shell surface to which it is attached, to contact the outer wall of the motor. In some particular embodiments, this projection distance (measured from the underlying wall to which it is attached) can be relatively small, such as, for example, about 10 mm or less. Where the motor 14 is cylindrical and it is desired that the motor mount members 130 conform to this shape, the inner-facing surface curvature of the at least one motor mount member 130 can be formed upon assembly and contact with the motor 14, but is typically pre-formed and in this configuration prior to assembly (e.g., formed during the overmold forming process).

As shown in FIG. 3, in some embodiments, a pair of closely spaced apart ribs 122 can define a mold cavity 121 that is a self-forming overmold space that accepts flowable mold material and facilitates formation of the overmold member 130. However, ribs or other integral structural features are not required as fabrication molds can be used to form the desired location and shape of the motor mount member 130. In some embodiments, as shown in FIG. 3, the at least one overmold motor mount member 130 can project a small distance inward (in a depth dimension) beyond the innermost surface of the ribs 121, toward the motor 14, such as between about 3 mm to about 0.1 mm, typically between about 1 mm to about 0.25 mm, and more typically between about 0.5 mm to about 0.25 mm.

The overall depth (the direction orthogonal to the width facing the motor outerwall) of a respective member 130 can vary. For example, the member 130 can have a shallow depth of between about 0.5 mm to about 10 mm, typically between about 1.5 mm to about 3 mm, or a larger depth of greater than 10 mm. The larger depth may, for example, be between 10 mm to about 50 mm, more typically between about 10-30 mm. The larger depth dimensions may be particularly suitable where deep troughs (e.g., closely spaced ribs 121) are used to help form the respective member 130.

As shown in FIG. 3, there are two motor mount members 130, including a forward member 130*a* and a rearward member 130*b* each having a width dimension "W" that can be substantially the same or different. The width dimension "W" extends in an axial direction. In some embodiments, one or both W dimensions can be between about 0.5 mm to about 35 mm. In some embodiments, the members 130*a*, 130*b* each can have narrow width configurations, such that they have a width "W" that is between about 0.5 mm to about 20 mm, and more typically is between about 1-10 mm. Different members 130 (where more than one is used) can have different widths W, such as a forward member 130 can have a larger width than a more rearward one 130, or vice versa. Placement of the members 130 may be such that they do not occlude or cover vents 14*v* in the motor (FIG. 2). Further, although not shown, three, four, or even more such members 130, having the same or different size widths W, and the same or different size depths (a dimension orthogonal to the width dimension) may be used. In some embodiments, depending on the motor, tool type, cavity size, and overmold material, it may be particularly suitable to use very narrow motor mount members 130 that have a width W that is between about 0.5 to about 5 mm that can be continuous or discontinuous about their perimeter, e.g., circumference or arc length, about the perimeter of the motor, to allow suitable heat distribution in the cavity 12*c* from heat generated by the motor 14.

Figure 4:
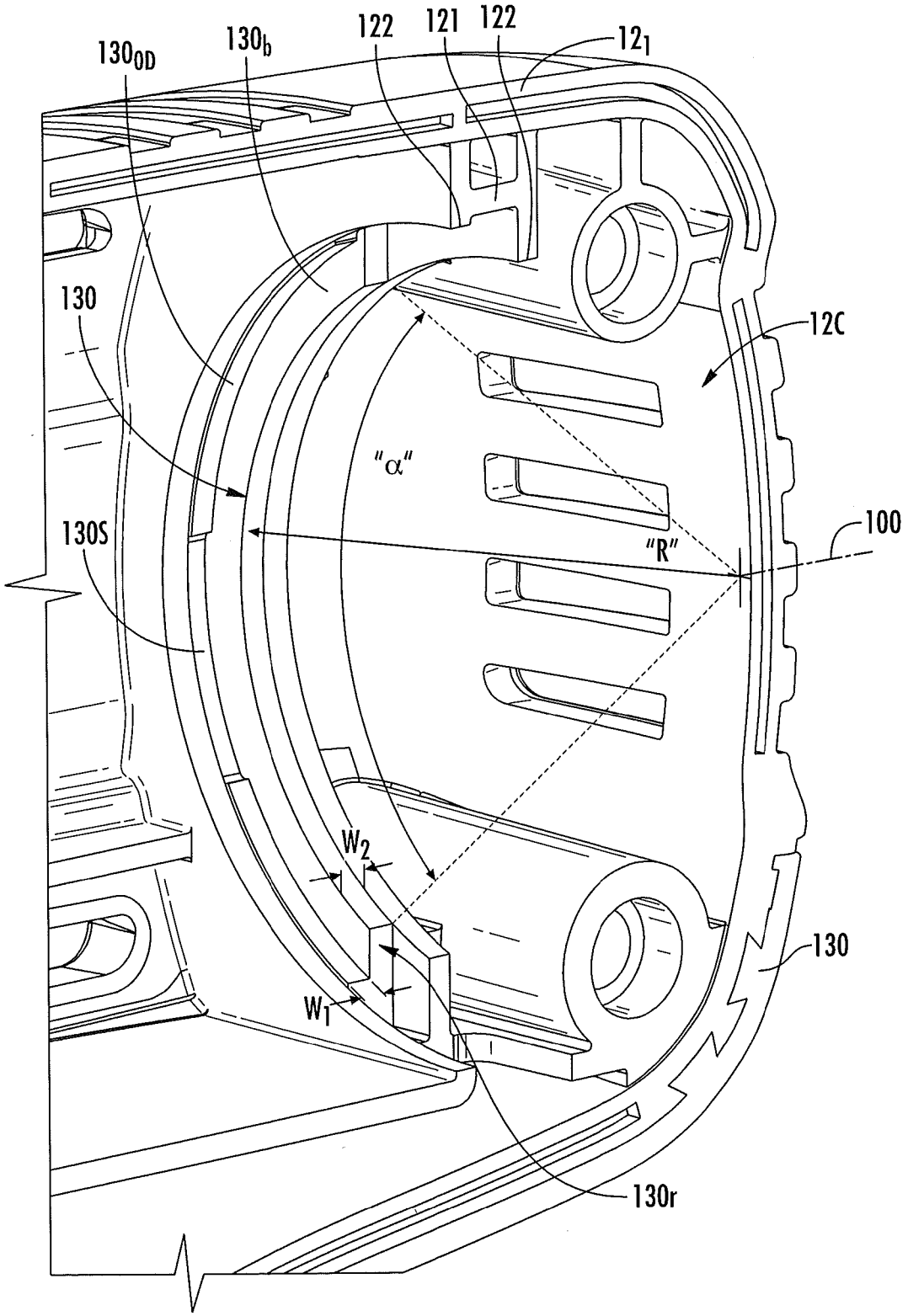
FIG. 4 is a greatly enlarged view of a rear portion of the housing shown in FIG. 3, without the motor, according to embodiments of the present invention.

As shown in FIG. 4, the at least one motor mount member 130 can, in some embodiments, circumferentially extend inside the cavity 12*c* and have a radius of curvature ("R") with respect to a centerline of the cavity 100 (that is concentric with that of the motor).

FIG. 4 also shows an enlarged view of the rearward mounting member 130*b* which illustrates the stepped configuration of this feature according to some embodiments. This configuration allows the member 130*f* to provide cushion or isolation force vectors in two directions that are substantially orthogonal to each other as shown by the proximately positioned arrows in FIG. 3. The mounting member 130*b* includes a first portion $\mathbf{130}_{OD}$ that contacts the outer diameter of the motor wall and a second rear portion 130*r* that contacts the rear or back end of the motor. The first portion $\mathbf{130}_{OD}$ can be discontinuous or segmented, shown at 130*s*, over its length. The second portion 130*r* is orthogonal to the first portion and can optionally be continuous about its length. The second portion 130*r* can extend inwardly a short distance beyond the first portion so as to be sized and configured to contact only a small portion of the rear surface of the motor, proximate an outer perimeter of the motor 14. This radially extending contact surface can be planar, relatively thin (e.g., between about 0.25 mm to about 1 mm), and can extend between about 1-30 mm from an outer edge of the motor. The first portion $\mathbf{130}_{OD}$ may have a first width "$W_1$" and the second portion 130*r* may have a second width "$W_2$" that together form the overall width "W". The widths $W_1$, $W_2$ can be the same or different. As shown, the first portion $\mathbf{130}_{OD}$ can be discontinuous about its perimeter with void spaces symmetrically positioned at regular angular intervals. This configuration can provide clearance for local structures to avoid degradation of the resilient member 130*b* where the motor includes sharp components that move while still providing vibration isolation or reduction.

The rearward member 130*b* can be configured without the stepped configuration similar to the first member 130*a* and may be positioned axially away from the rear surface. Also, or alternatively, the rear member 130*b* can be provided as two discrete members, including one similar to the first member 130*a*, and a separate resilient integral washer-like configuration that can be overmolded onto an interior wall of the cylindrical cavity 12*c* proximate the rear of the motor to provide cushion in this region if desired. This overmold motor mount 130*b* contact can be configured as a flat, relatively thin or narrow integrally attached resilient overmold member that is held entirely inside the interior cavity without communication with an external overmold and sized to contact only a small portion of only the bottom/rear surface of the motor, typically only about 1-20% of the surface area, to allow for heat dissipation while providing a small forward bias for the motor.

Figure 5:
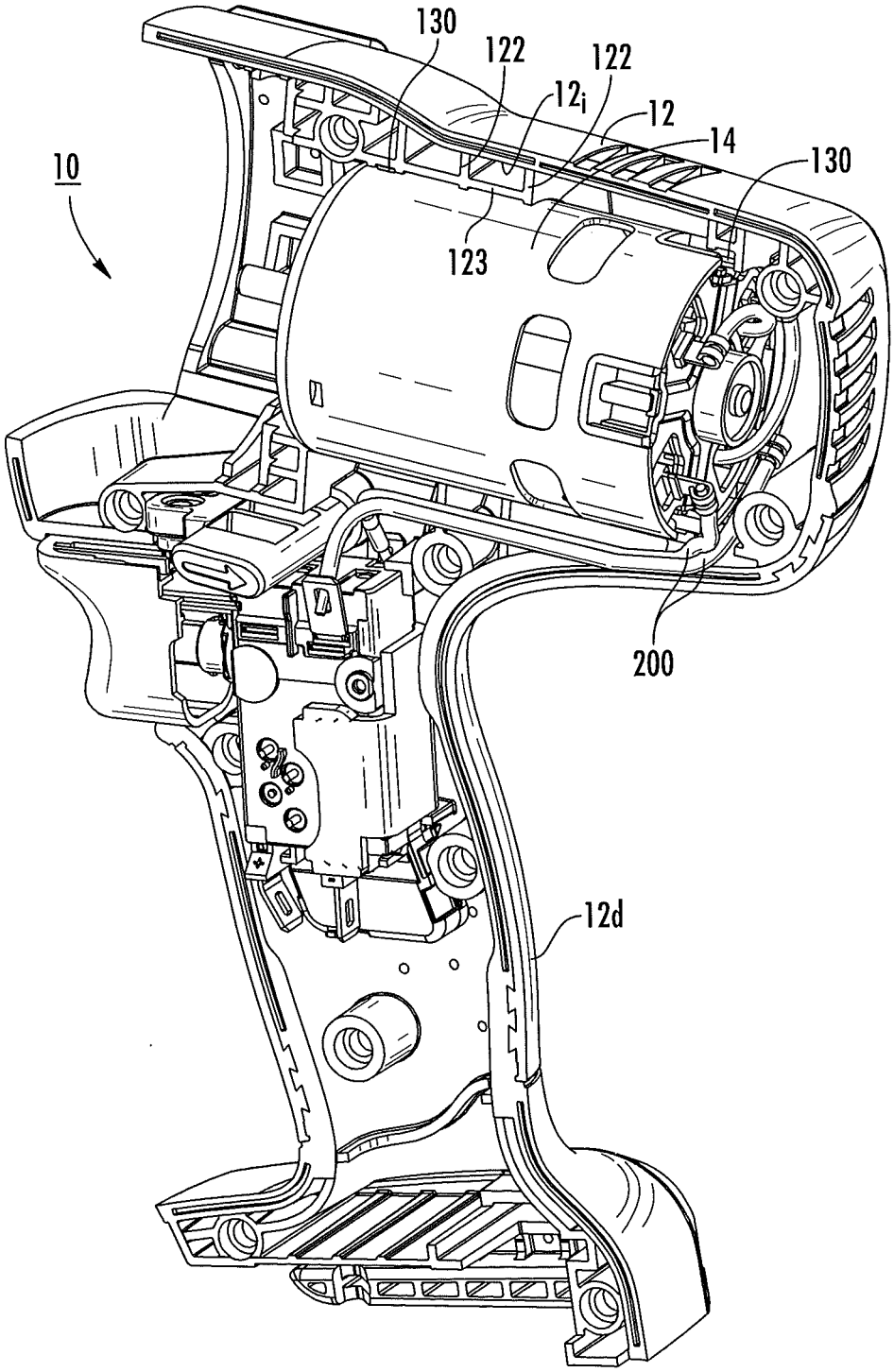
FIG. 5 is a side perspective, partial assembly section view of the right side of the housing of the tool shown in FIG. 2 according to embodiments of the present invention.

Still referring to FIG. 4, the members 130*a*, 130*b* can be configured to circumferentially extend over an arc at an angle "α" about the cavity 12*c*. This angle α is typically between about 90-180 degrees within each shell body $\mathbf{12}_1$, $\mathbf{12}_2$. FIG. 5 illustrates that the rear mounting member 130*b* extends for example between about 145-170 degrees about the perimeter of the cavity 12*c* so that an open path for wires 200 or other components can be routed in the housing past the motor to the internal handle portion 12*d*.

Figure 6A:
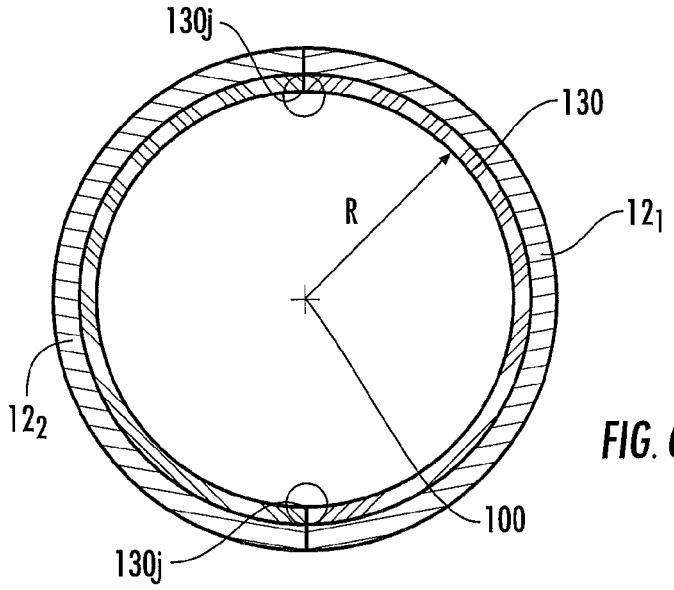
FIGS. 6A-6C are end section schematic illustrations of the housing and motor with examples of alternate integral overmold elastomeric motor mount configurations according to embodiments of the present invention.
Figure 6B:
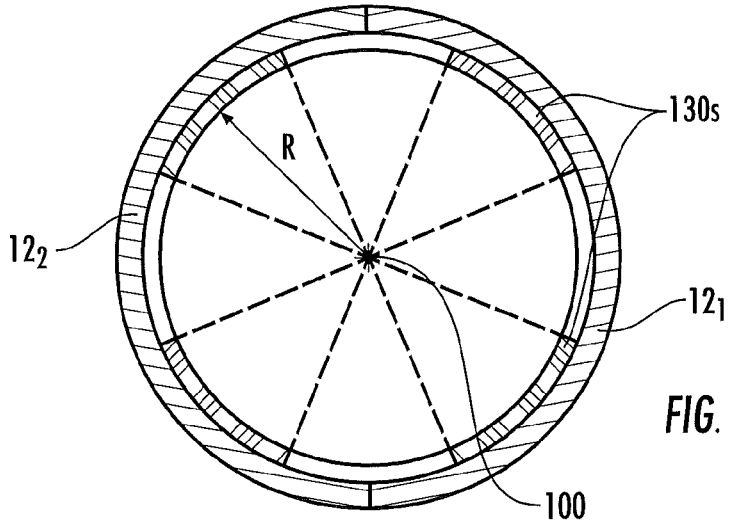
Figure 6C:
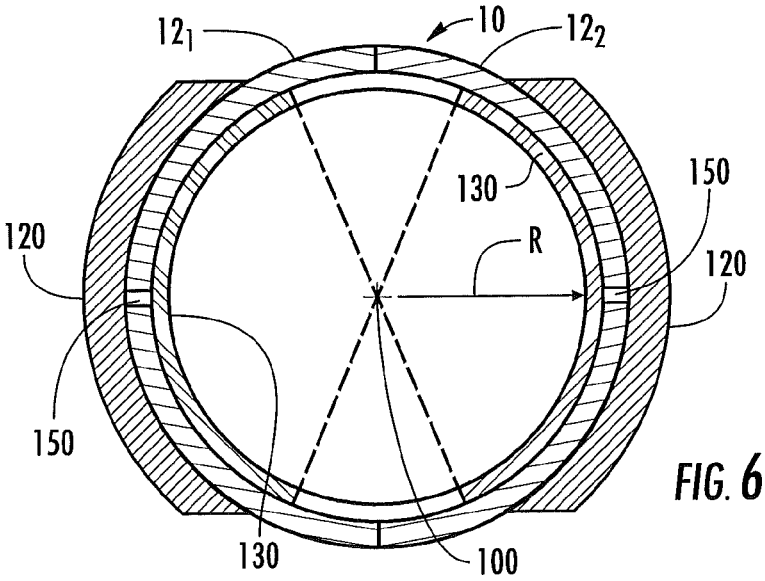

The motor mount members 130 for each housing shell $\mathbf{12}_1$, $\mathbf{12}_2$ can be symmetrically arranged so that, when assembled, the motor mounts on each housing inner surface 12*i* face each other across a cylindrical cavity 12*c* defined by the housings $\mathbf{12}_1$, $\mathbf{12}_2$ and snugly reside against an outer surface of the motor 14. FIG. 6A illustrates that a corresponding portion of the member 130 in each housing shell $\mathbf{12}_1$, $\mathbf{12}_2$ can extend about 180 degrees, forming about a 350-360 degree member when assembled together, with a tight or loose seam or joint 130*j* at adjacent edges when assembled. FIG. 6B illustrates that the member 130 can be segmented (at 130*s*) within each housing shell $\mathbf{12}_1$, $\mathbf{12}_2$ to each circumferentially extend between about 30-90 degrees (so as to be discontinuous about the perimeter of the motor). FIG. 6C illustrates that each shell can have a member 130 that extends continuously for their respective lengths, but over a subset of the circumference of the respective shell $\mathbf{12}_1$, $\mathbf{12}_2$, e.g., between about 120-170 degrees. FIG. 6C also illustrates that the housing 12 can have a material flow path 150 that allows the external overmold 120 material to have a fluid path to the internal overmold for the respective motor mount 130 for some embodiments mount as discussed further below.

As also shown in FIGS. 3-5, in some embodiments, the housing shell inner surfaces 12*i* can support ribs 121 and an axially extending interior flat sub-surface 123 attached to the ribs 121. This sub-surface 123 can provide increased structural support for the shell bodies and/or size the cavity 12*c* to receive the motor without excess spacing. The overmold motor mount members 130 can be integrally attached to the flat sub-surface 123 and/or ribs 121. However, the overmold motor mount(s) 130 may also be integrally attached to directly to the inner surface at the outer wall rather to an internal structural sub-feature extending inward from the outer wall. The ribs 121 may be circumferentially extending in the cavity 12*c* and project inwardly from the outerwall of a respective housing shell $\mathbf{12}_1$, $\mathbf{12}_2$.

The at least one motor mount 130 can be positioned in the cavity 12*c* to be slightly oversized so as to compress upon contact with the outerwall of the motor 14 during assembly of the two shells $\mathbf{12}_1$, $\mathbf{12}_2$ together. That is, as the housing shells $\mathbf{12}_1$, $\mathbf{12}_2$ are assembled and attached to each other, typically using threaded screws, the innermost (free end) of the respective motor mounts 130 are pushed outward toward the respective shell outerwall and snugly contact the motor 14. The motor 14, when attached to the drive train 20 (FIGS. 11 and 12) may be pushed slightly rearwardly against member 130*b* (FIG. 3), which can provide a forward bias while the motor is held snugly in the cavity 12*c*.

The at least one motor mount member 130 can be formed onto the respective substantially rigid shell bodies $\mathbf{12}_1$, $\mathbf{12}_2$by a single shot or multi-shot molding process. The molding processes are well known to those of skill in the art. The at least one motor mount 130 can be a monolithic member of one material or a laminate member of different elastomeric materials having different durometers. For example, the motor mount member 130 can comprise at least two overlying layers, including a first resilient material having Shore A durometer between about 20 to about 40 and a second resilient material having a Shore A durometer between about 40 to about 65. In some embodiments, the softer material may face the motor 14. In other embodiments, the softer material may face the respective housing shell $\mathbf{12}_1$, $\mathbf{12}_2$. For motor mounts 130 with multiple layers of materials $\mathbf{130}_1$, $\mathbf{130}_2$, a multi-shot molding process can be used as is well known to those of skill in the art. See, e.g., Venkataswamy et al., *Overmolding of Thermoplastic Elastomers: Engineered solutions for consumer product differentiation*, pp. 1-18, Jun. 19, 2007, GLS Corporation, McHenry, Ill.; and *Overmolding Guide;* copyright 2004, GLS Corporation, McHenry, Ill.

Figure 7:
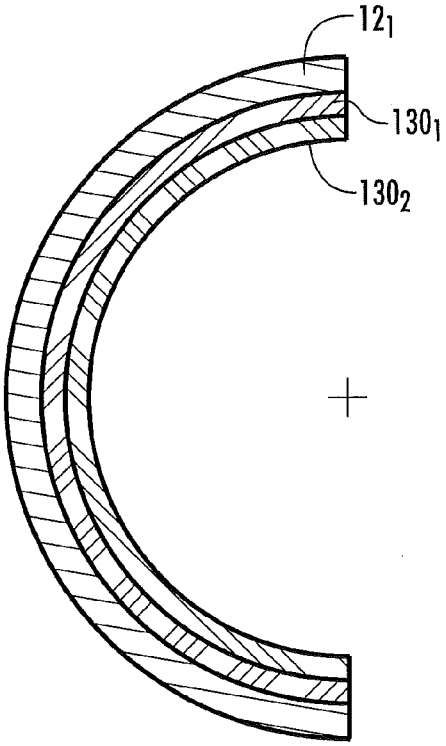
FIG. 7 is a schematic illustration of one housing shell with interior integral motor mounts having a plurality of different stacked elastomeric overmold materials according to embodiments of the present invention.

FIG. 7 illustrates a housing shell (showing only one side) $\mathbf{12}_1$ with two stacked layers (e.g., a two-shot) forming the overmold motor mount 130 integrally attached to the inner wall or other structural feature of the cavity 12*c*. The first layer can comprise a first resilient material $\mathbf{130}_1$ and the second, a second resilient material $\mathbf{130}_2$. The inwardly facing layer may have a smaller cross-section or width relative to the underlying layer to provide for compression adjustment.

Figure 8A:
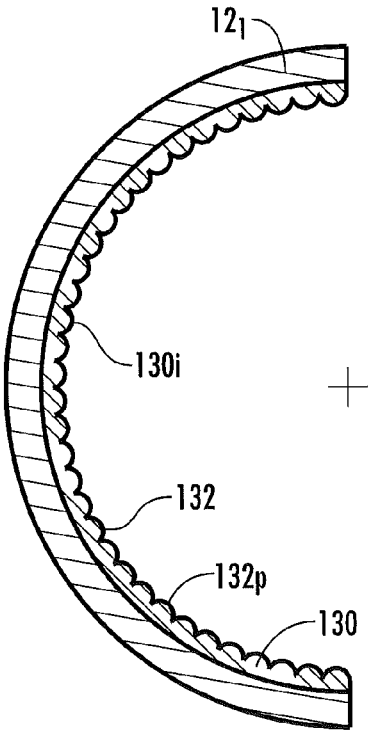
FIGS. 8A and 8B are schematic illustrations of one housing shell with interior integral elastomeric overmold motor mounts having surface modifications to reduce contact area with the motor according to embodiments of the present invention.
Figure 8B:
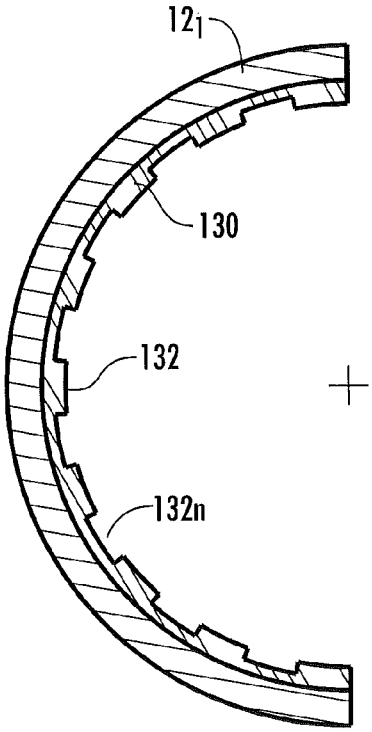

While FIGS. 2, 3 and 5, for example, show the motor mounts 130 having a smooth constant size and a flat inner surface, embodiments of the invention contemplate that the inner surface 130*i* may have other configurations. For example, FIGS. 8A and 8B illustrate that the motor mount 130 can be configured to have reduced contact surface area 132 on the inner surface. FIG. 8A illustrates a dimpled or embossed surface pattern 132*p* while FIG. 8B illustrates a notched pattern 132*n*. These reduced contact surfaces 132 may be particularly useful where larger size (in width "W") overmold motor mounts 130 are used.

The internal overmolds for the motor mount(s) 130 may bleed or otherwise be introduced using an access path 150 (FIG. 6C) from an opening in the housing outer wall. If so, a single shot molding process can be used to substantially concurrently form the outer and inner overmold portions 120, 130. In other embodiments, the outer overmold portions 120 can be formed separately and independently from the inner surface overmolds forming the motor mounts 130. The inner surface of the respective housing shell $\mathbf{12}_1$, $\mathbf{12}_2$ at the overmold contact/attachment locations may be roughened for facilitating a secure attachment but it is believed that a sufficiently secure attachment can be achieved without requiring this step.

Figure 9:
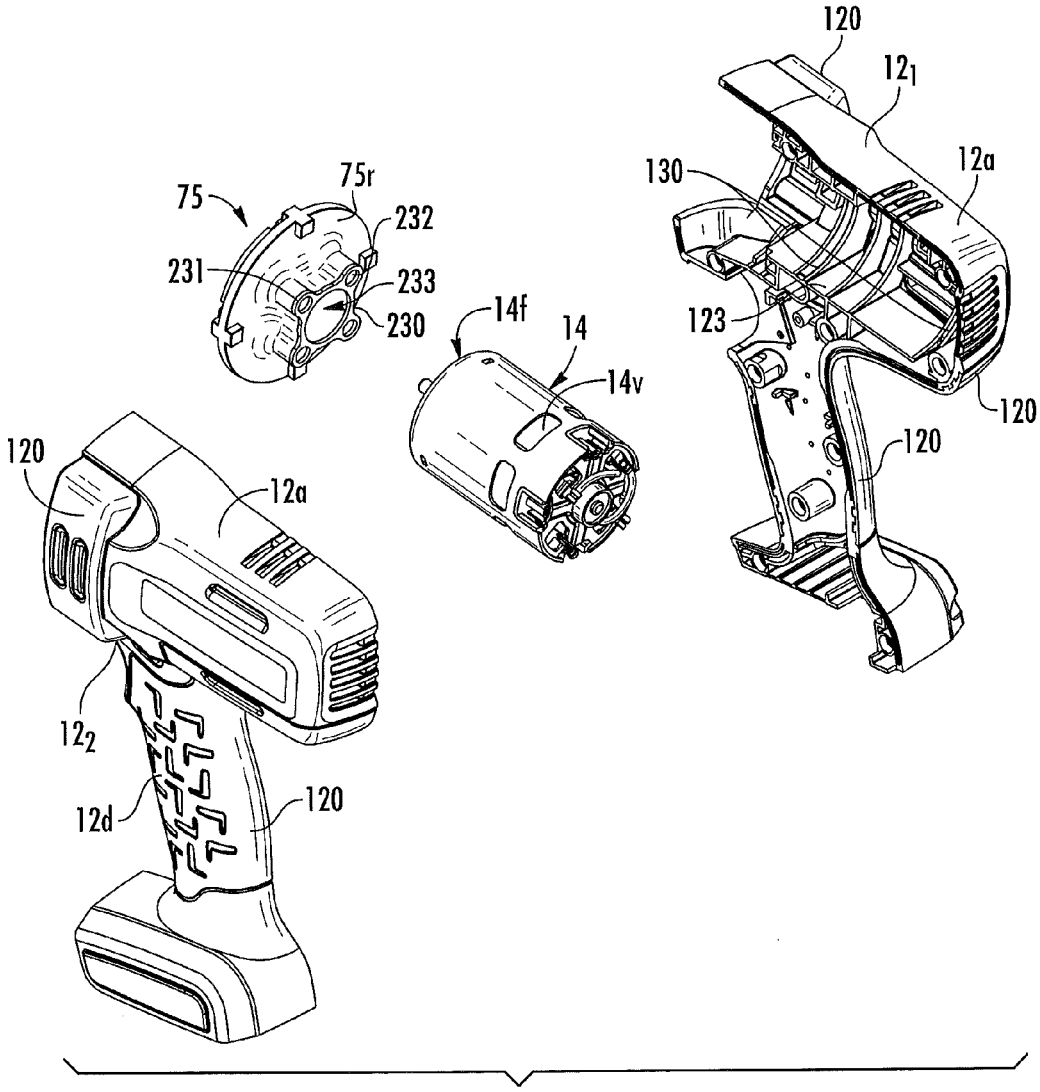
FIG. 9 is an exploded, perspective view of a portion of the power tool shown in FIGS. 1A and 1B illustrating an optional embodiment of the present invention according to some embodiments of the present invention.
Figure 10:
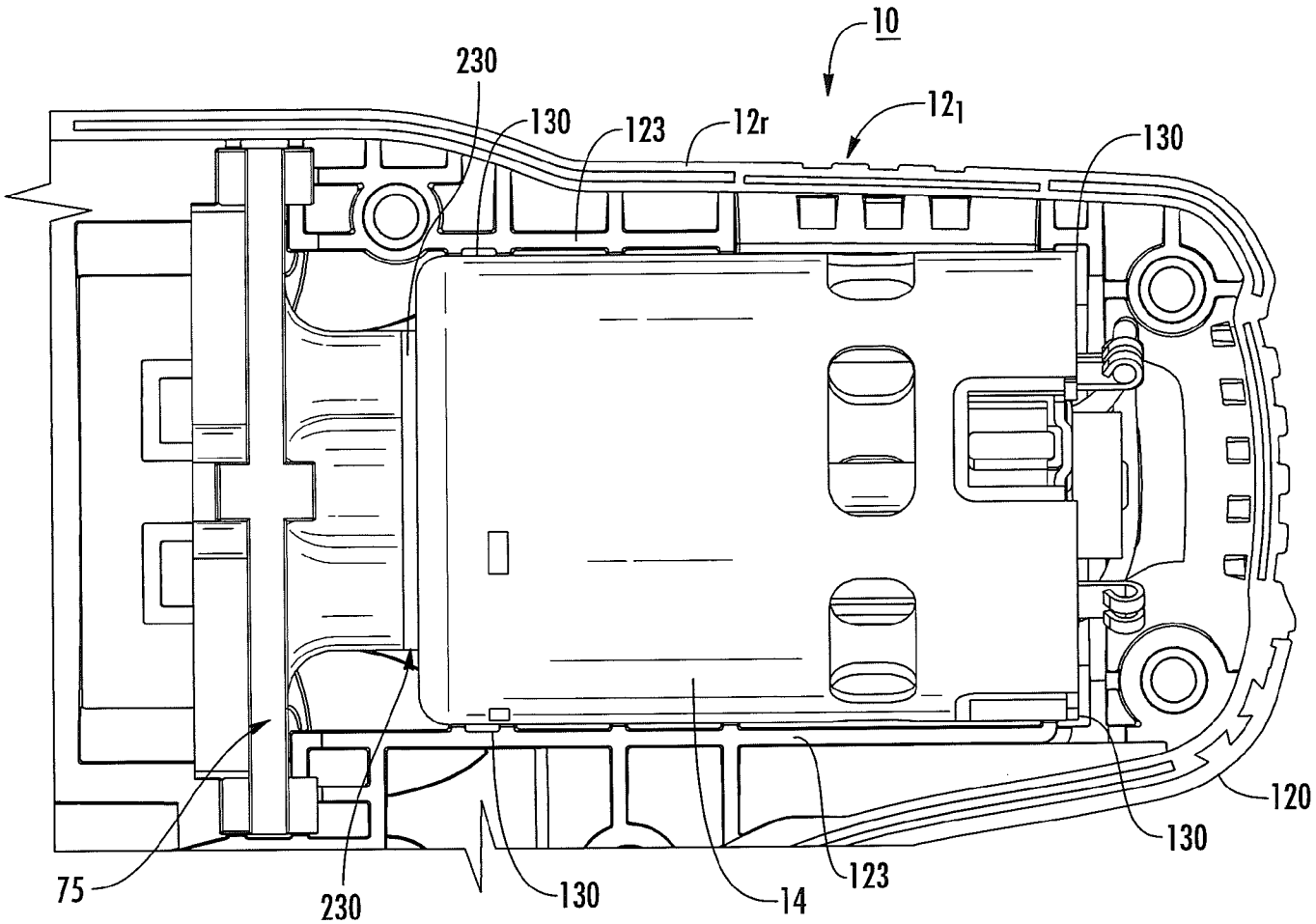
FIG. 10 is an enlarged partial section assembled view of a rear portion the tool shown in FIG. 9 according to embodiments of the present invention

FIGS. 9 and 10 illustrate that, in some embodiments, the tool 10 can include a gear carrier 75 that includes a substantially planar resilient overmold portion 230 on a flat surface of the more rigid carrier substrate 75r that faces the motor 10. The overmold portion 230 has a circular center opening 233 corresponding to an opening in the carrier 75 to accept a rotor or shaft extending from the motor. The overmold portion 230 can be formed to include a plurality of corners 231 with respective apertures 232 to allow for threaded attachment members to extend therethrough to attach the gear carrier 75 to a front end of the motor. The shape of the rear face or surface of the gear carrier 75 and/or overmold 230 thereon may vary depending on the motor 14. In this embodiment, the shape is suitable for a motor with air slots 14s on the end face (FIG. 11). The thickness of the overmold portion 230 can vary, but is typically between about 1 mm to about 150 mm, typically between about 1 mm to about 10 mm.

FIG. 11 is an exploded assembly view and FIG. 12 is an assembled view of the embodiment shown in FIGS. 9 and 10 with the drive train 20 aligned with the gear carrier 75. FIGS. 11 and 12 illustrate the gear carrier 75 in position with the overmold 230 between the substrate of the gear carrier 75*r*, contacting the front surface of the motor 14*f*.

As shown in FIG. 12, the gear carrier 75 snugly abuts the forward surface of the motor 14 and the overmold portions 130, 230 can provide shock or vibration isolation or resistance.

The motor 14 can be held in a desired fixed position and orientation in the housing 12, but may have a small amount of axial movement (e.g., "kick") during operation. The gearcase 16 (FIG. 1A) can encase the drive train 20 and be rigidly mounted to create a single unified drive train. Referring to FIGS. 11 and 12, the motor 14 includes a motor rotor 22 (e.g., motor output shaft) 22 that extends toward the tool output shaft 18 and has a centerline that coincides with a drive train center axis 24. The motor rotor 22 is attached to a pinion gear 25 having a plurality of splines or teeth 26. The motor rotor 22 drives the pinion 25 that engages the drive train 20, which thereby drives the tool output shaft 18.

The drive train 20 includes a first stage of planetary gears and a second stage of planetary gears that reside inside a ring gear 70, as is known to those of skill in the art. See, e.g., U.S. patent application Ser. No. 12/328,035 and U.S. Pat. No. 7,896,103 for examples of power tool drive trains, the contents of which are hereby incorporated by reference as if recited in full herein. The ring gear 70 does not itself rotate but defines an outer wall for the planetary gears. The ring gear 70 is cylindrical and includes a wall with an inner surface that includes elongate teeth or splines 71. The teeth of the gears can substantially mate with the ring gear splines or teeth 71 as the planetary gears rotate inside the ring gear 70 during operation.

The drive train 20 first stage of planetary gears is typically three planetary gears and the teeth substantially mate with the teeth 26 of the pinion gear 25. The drive train 20 also includes a gearhead with a gear with splines or teeth and a plate (the plate faces the first stage of gears 30). The first stage of gears drives the gearhead. The second stage of planetary gears also typically includes three planetary gears with external teeth. The gearhead resides downstream of the first stage of gears and drives the second stage of gears. Thus, the first stage (e.g., set) of gears orbit about the pinion 25 and the second stage (e.g., set) of gears orbit about the output gear of the gearhead. In turn, the second stage of gears drive a carrier which drives the tool output shaft 18. A portion of the carrier also resides within the ring gear 70 with a center hub that extends a distance outside the ring gear 70 and holds the tool output shaft 18.

Figure 13:
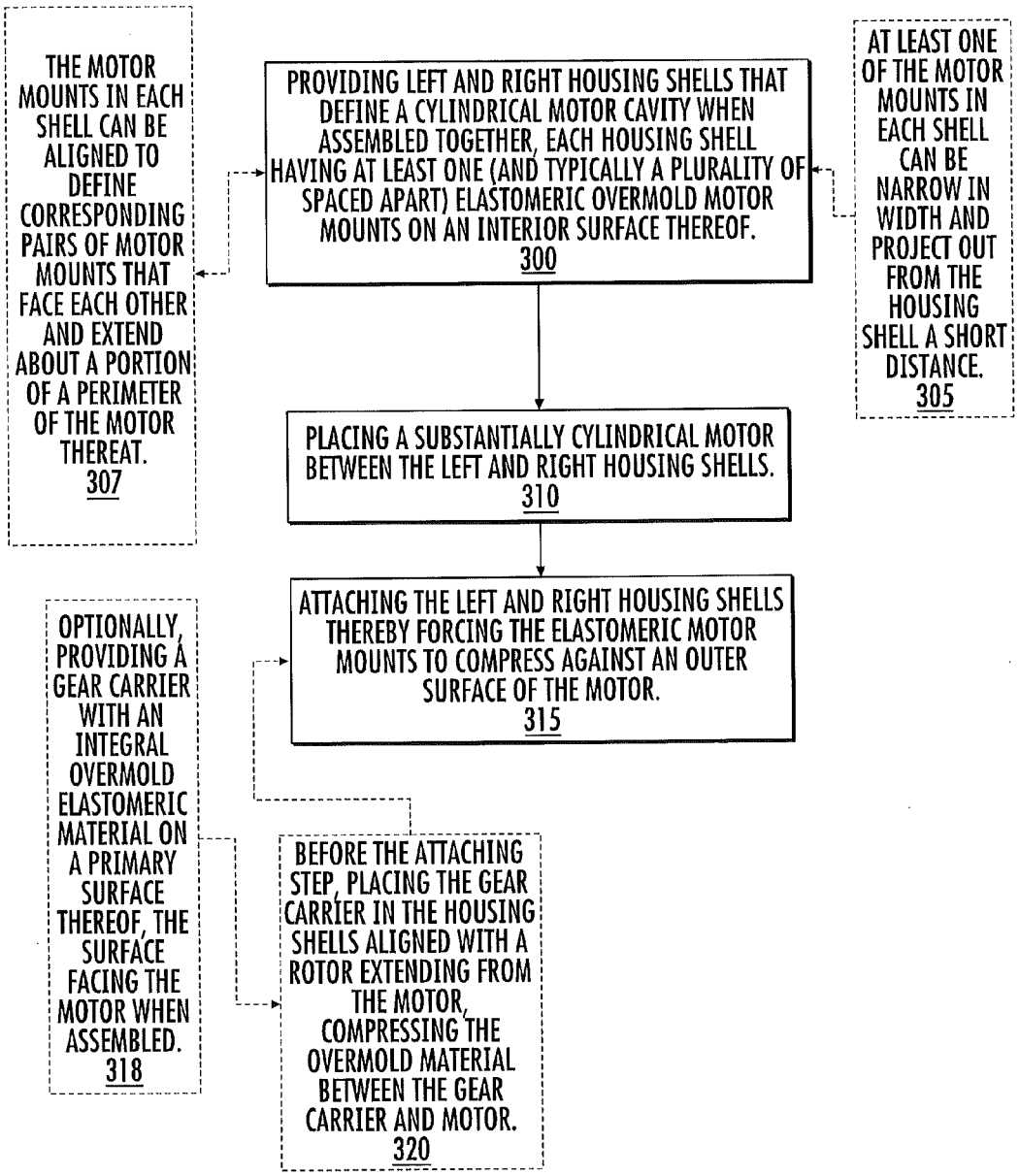
FIG. 13 is a flow chart of exemplary assembly steps that can be used to assemble a power tool according to embodiments of the present invention.

FIG. 13 is a flow chart of exemplary steps that can be used to assemble a power tool according to embodiments of the present invention. As shown, left and right housing shells that define a cylindrical motor cavity when assembled together are provided, each housing shell having at least one (and typically a plurality of spaced apart) elastomeric overmold motor mount on an interior surface thereof (block 300). A substantially cylindrical motor is placed between the left and right housing shells (block 310). The left and right housing shells are attached together, thereby forcing the elastomeric motor mounts to compress against an outer surface of the motor (block 315).

At least one of the motor mounts in each shell can be narrow in width and project out from the housing shell (at a location of the interior shell to which it is attached) a short distance (block 305). Typically, the narrow dimension is between about 0.5 mm to about 20 mm, such as between about 1 mm to about 20 mm, typically between about 1-10 mm. The short distance can be between about 0.25 mm to about 10 mm, more typically between about 0.25 mm to about 1 mm.

The motor mounts in each shell can be aligned to define corresponding pairs of motor mounts that face each other and extend about a portion of a perimeter of the motor thereat (block 307).

Optionally, the method may include providing a gear carrier with an integral overmold elastomeric material on a primary surface thereof, the surface facing the motor when assembled (block 318). Before the attaching step, the method may also include placing the gear carrier in the housing shells aligned with a rotor extending from the motor, thereby compressing the overmold material between the gear carrier and motor (block 320).

Figure 14:
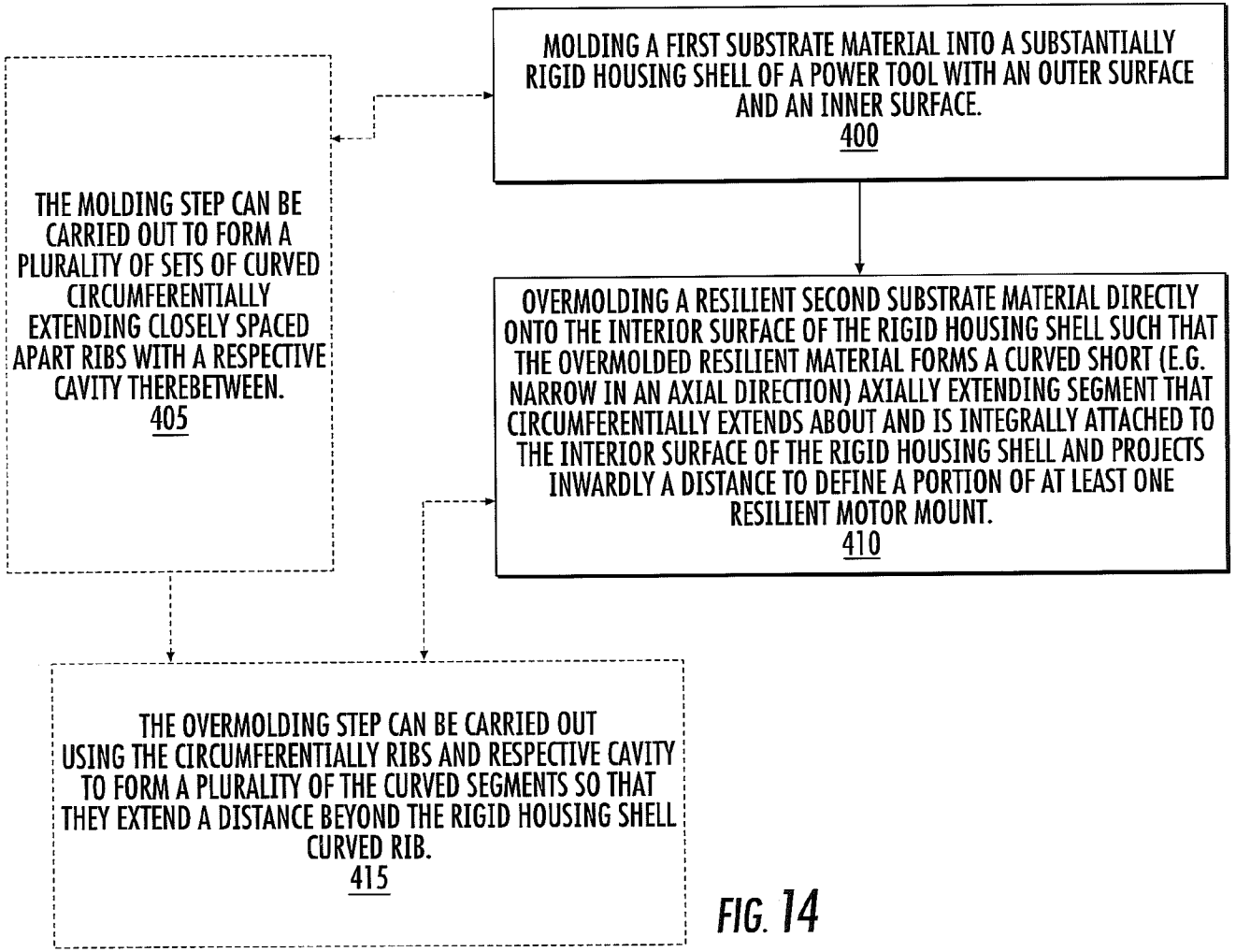
FIG. 14 is a flow chart of exemplary housing shell forming steps that can be carried out to form the housing shell with an integral motor mount according to embodiments of the present invention.

FIG. 14 is a flow chart of exemplary method steps of fabricating a housing shell with integrated resilient overmold material for at least one motor mount of a power tool. As shown, a first substrate material is molded into a substantially rigid housing shell of a power tool with an outer surface and an inner surface (block 400). A resilient second substrate material is directly overmolded onto the interior surface of the rigid housing shell such that the overmolded resilient material forms at least one curved, short (narrow), axially-extending segment that circumferentially extends about and is integrally attached to the interior surface of the rigid housing shell and projects inwardly a distance to define a portion of at least one resilient motor mount (block 410).

The molding step can be carried out to form at least a plurality of curved, circumferentially-extending, closely spaced apart ribs with a cavity therebetween (block 405). The overmolding step can be carried out using the circumferentially extending ribs and respective cavities to form a plurality of curved resilient segments, wherein the overmolding step forms the curved segment, so that they extend a distance beyond the rigid housing shell curved ribs (block 415).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses, if used, are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A power tool housing, comprising:

first and second housing shells that each have an outer wall that encases inner surfaces, wherein the housing shells matably attach to each other and define an interior motor cavity that is sized and configured to encase at least a motor associated with a power train for a power tool, wherein each housing shell is a substantially rigid molded shell body, and wherein each housing shell includes a plurality of axially spaced apart overmold motor mount member portions comprising an elastomeric material that are directly, integrally attached to at least one inner surface of the respective housing shell.

2. The power tool housing of claim 1, wherein one or sets of the axially-spaced apart overmold motor mount member portions of the first housing shell are aligned with one or sets of motor mount member portions of the second housing shell and define a plurality of axially spaced apart overmold motor mount members.

3. The power tool housing of claim 2, wherein the plurality of overmold motor mount members includes first and second overmold motor mount members that each have a width that is between about 0.5 mm to about 10 mm in a width dimension associated with an axial direction of the cavity and each projects inwardly a distance from a housing shell attachment surface.

4. The power tool of claim 2, wherein the plurality of motor mount members is two axially spaced apart, curved motor mount members, each defined by cooperating semicircular overmold motor mount member portions, and wherein the overmold motor mount member portions extend circumferentially between about 90-180 degrees about the interior motor cavity.

5. The power tool housing of claim 2, wherein the interior cavity is substantially cylindrical, and wherein the plurality of axially spaced apart overmold motor mount members includes one that resides closer to the rear of the cylindrical cavity than another, and wherein some of the overmold motor mount members have a substantially common radius of curvature measured from a centerline of the cavity and a circumferentially extending length in each respective housing shell that is between about 90-180 degrees.

6. The power tool housing of claim 2, wherein the overmold motor mount members include a motor mount member that resides proximate the rear of the interior cavity that has a stepped configuration, with (i) a forward portion that is sized and configured to snugly abut an outer cylindrical wall of a motor held thereat being discontinuous about its circumference and (ii) a second portion that is substantially orthogonal to the first portion and has a planar configuration that extends inwardly from the first portion a short distance between about 1 mm to about 30 mm.

7. The power tool housing of claim 2, wherein the plurality of overmold motor mount members includes at least one motor mount member residing proximate a front end of the interior motor cavity and at least one motor mount member spaced apart and residing closer to a rear end of the interior cavity.

8. The power tool housing of claim 1, wherein each housing shell includes at least one cooperating pair of aligned, circumferentially extending overmold motor mount member portions that define a respective overmold motor mount member.

9. The power tool housing of claim 1, wherein at least one of the overmold motor mount member portions of each housing shell resides intermediate a pair of closely spaced apart housing ribs and projects inwardly toward a center of the interior cavity from the respective ribs between about 0.25 mm to about 1 mm, and wherein the ribs extend inwardly from an inner surface of the respective housing shell and also extend circumferentially at an arc of between about 90-180 degrees about the interior motor cavity.

10. The power tool housing of claim 1, wherein the housing shell inner surfaces include circumferentially-extending support ribs and an axially extending planar sub-surface attached to the ribs, wherein at least some of the overmold motor mount member portions are integrally attached to the sub-surface, and wherein the overmold motor mount member portions include a plurality of narrow, axially spaced apart overmold motor mount member portions that project inwardly from the sub-surface between about 0.5 mm to about 1 mm.

11. The power tool housing of claim 1, wherein the plurality of overmold motor mount member portions comprises at least one overmold motor mount member portion with two different stacked thermoplastic elastomers.

12. A power tool, comprising:

first and second housing shells that matably attach to each other and define an interior motor cavity, wherein each housing shell is a substantially rigid molded shell body that defines an outer wall and inner surfaces, and wherein each of the first and second housing shells includes at least one cooperating portion of a resilient overmold motor mount member that is integrally attached to at least one of the inner surfaces of a respective housing shell; and a motor that resides in the interior motor cavity, the motor having an outer wall that snugly abuts the overmold motor mount member.

13. The power tool of claim 12, wherein each housing shell comprises a plurality of axially spaced apart resilient overmold motor mount portions that are integrally attached to defined locations of at least one of the inner surfaces of the respective housing shell and cooperate to define respective spaced apart overmold motor mount members, wherein at least two of the overmold motor mount portions have a width dimension associated with an axially extending direction of the interior motor cavity that is between about 0.5 mm to about 10 mm.

14. The power tool of claim 13, wherein one of the overmold motor mount members has a stepped configuration, with (i) a forward portion that is sized and configure to snugly abut an outer cylindrical wall of a motor held thereat and having a discontinuous configuration about its circumference and (ii) a second portion that is substantially orthogonal to the first portion and has a planar configuration that extends inwardly from the first portion a short distance between about 1 mm to about 30 mm.

15. The power tool of claim 12, further comprising a gear carrier with opposing end portions residing aligned with the motor in the housing shell, wherein the end portion facing the motor includes a substantially planar resilient overmold portion directly integrally attached thereto, the overmold portion having an open center space.

16. The power tool of claim 12, wherein the overmold motor mount portions have a width of between about 1 mm to about 10 mm in a width dimension associated with an axial direction of the interior cavity, and wherein the housing shell inner surfaces include circumferentially extending support ribs and an axially extending planar sub-surface attached to the ribs, wherein the overmold motor mount portions are integrally attached to the planar sub-surface.

17. The power tool of claim 12, wherein each housing shell includes at least one pair of closely spaced interior ribs with a cavity therebetween, and wherein the overmold motor mount portions reside in the cavity intermediate the pair of closely spaced apart ribs, the ribs extending inwardly from an inner surface of the respective housing shell and also extending circumferentially at an arc that is between about 90-180 degrees about the substantially cylindrical cavity, and wherein the overmold motor mount portions project outwardly from at least one the respective closely spaced apart ribs between about 0.25 mm to about 1 mm.

18. The power tool of claim 12, further comprising a second resilient overmold motor mount integrally attached to at least one inner surface of a respective housing shell, and wherein one of the overmold motor mount portions of each housing shell defines a rear motor mount that resides closer to the rear of the interior cavity and each has a radius of curvature extending from a centerline of the cavity to an inner surface thereof and a perimeter with a circumferentially extending arc that is between about 90-170 degrees.

19. The power tool housing of claim 12, wherein the first and second housing shells are right and left clam shell housings, each with a lower upwardly extending handle portion that merges into an upper axially extending elongate portion that, when attached together, define a substantially cylindrical interior motor cavity, and wherein each housing shell includes a plurality of axially spaced apart overmold motor mount portions including a pair or set that define a rear overmold motor mount member that reside in each housing shell adjacent a rear corner of the substantially cylindrical cavity, and wherein the rear overmold motor mount portions have at least one of a segmented configuration or a circumferentially extending length that this less than about 170 degrees.

20. A method of assembling a power tool, comprising:

providing left and right housing shells that define a motor cavity when assembled together, each housing shell having a plurality of spaced apart elastomeric overmold motor mounts on an interior surface thereof, at least some of which are narrow in width (in an axially extending dimension) with a width of between about 1 mm to about 20 mm;

aligning the left and right shells so that motor mount portions in each shell define corresponding sets of motor mounts that face each other and extend about a portion of a perimeter of the motor thereat;

placing a motor between the left and right housing shells;

attaching the left and right housing shells together, thereby forcing the elastomeric motor mounts to compress against an outer surface of the motor, and optionally, before the attaching step, placing a gear carrier with an integral overmold elastomeric material on a primary surface in the housing shells aligned with a rotor extending from the motor so that the overmold material between the gear carrier and motor is compressed before or in response to the attaching step.

* * * * *